US007004131B1

(12) United States Patent
Plenzler et al.

(10) Patent No.: US 7,004,131 B1
(45) Date of Patent: Feb. 28, 2006

(54) ENGINE SHAFT PUMP

(75) Inventors: Jeremy M. Plenzler, Royal Oak, MI (US); Liyun Zheng, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/912,016

(22) Filed: Aug. 5, 2004

(51) Int. Cl.
*F01M 1/06* (2006.01)

(52) U.S. Cl. ..... 123/90.34; 123/196 R; 184/31; 384/288

(58) Field of Classification Search ..... 123/196 R, 123/192.2; 184/31; 384/288, 289, 291
See application file for complete search history.

(56) References Cited

U.S. PATENT DOCUMENTS 5,816,205 A * 10/1998 Moriya ..... 123/90.17

6,189,499 B1 * 2/2001 Iwata et al. ..... 123/192.2

* cited by examiner

*Primary Examiner*—Mahmoud Gimie
*Assistant Examiner*—Katrina Harris
(74) *Attorney, Agent, or Firm*—Christopher DeVries

(57) ABSTRACT

A rotary shaft pump for increasing supplied oil pressure to a pressure responsive device in an internal combustion engine. The pump includes a housing adapted to carry a plurality of axially spaced journals of a rotatable shaft. The shaft also includes at least one pumping element having a larger diameter than the other journals of the shaft. A cam phaser carried on one end of the shaft receives pressurized oil from the engine through oil passages extending through the housing and the shaft. As the oil is pumped through the oil passages of the shaft, the oil is centrifugally pumped through a radially extending pumping passage extending though the pumping element to boost oil pressure supplied to the cam phaser.

13 Claims, 1 Drawing Sheet

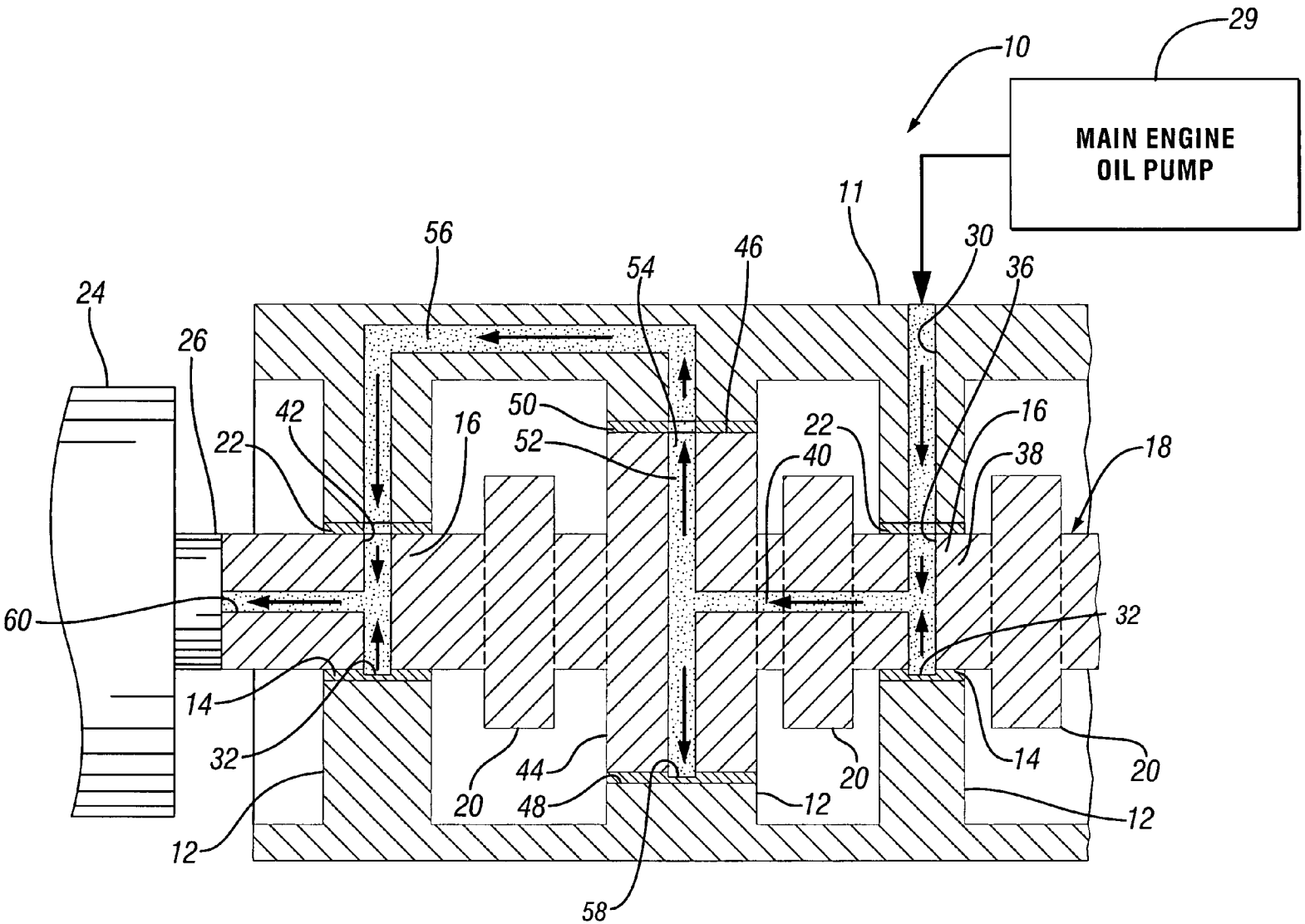
MAIN ENGINE OIL PUMP
29
10
11
30
36
18
16
38
32
20
14
12
22
40
46
54
50
52
56
42
26
24
60
58
44
48

ENGINE SHAFT PUMP

TECHNICAL FIELD

This invention relates to engine oil pumps and, more particularly, to an engine shaft with an internal rotary shaft pump for boosting engine oil pressure to a selected device or portion of an engine oil system.

BACKGROUND OF THE INVENTION

Engines having cam phasers or other hydraulic devices may require higher than normal oil pressure for actuation of these devices. As a result, such engines commonly utilize larger than normal oil pumps to provide the required oil pressure for actuation of such devices. However, these larger oil pumps may require additional oil pump packaging space and greater energy for operation.

SUMMARY OF THE INVENTION

The present invention modifies a rotatable shaft of an engine, such as a camshaft or a balance shaft and a support member or web supporting the shaft to form a rotary shaft pump for increasing oil pressure supplied to an engine cam phaser or other hydraulic device.

In an exemplary embodiment, the rotary shaft pump includes a camshaft having axially spaced lobes adapted for engine valve train actuation and a plurality of axially spaced journals for carrying the camshaft within a housing or support portion of an engine. The camshaft also includes at least one radially extending pumping element which may act as a journal but has a greater diameter than the other camshaft journals. A cam phaser disposed at one end of the camshaft receives pressurized oil from the engine through oil passages extending through the camshaft.

The oil passages delivering oil the cam phaser may be arranged in various configurations within the scope of the invention. In an exemplary embodiment, oil is delivered to the cam phaser through a series of interconnected oil passages extending through the camshaft. Oil is supplied to the cam phaser from an engine oil feed passage in a camshaft support web. The engine oil feed passage connects with a groove in a journal bearing or insert that carries oil to a cross drilled oil inlet passage, extending radially into the first journal and connecting with a distribution passage extending axially through the center of the camshaft. The distribution passage connects with one or more radial journal lubrication passages for delivering oil to the surface of the journals to lubricate the journal bearings along the length of the camshaft.

A pumping passage extends radially through the large diameter journal or pumping element and extends from the distribution passage to the outer diameter of the pumping element. The pumping passage connects through a groove in a journal bearing with a delivery passage connecting with the bearing groove in the stationary support or web surrounding the pumping element. The delivery passage carries pressurized oil in any suitable manner to a cam phaser for actuating the phaser. For example, the oil may be redirected back to another distribution oil passage beyond the pumping element to supply pressure oil to a cam phaser at the end of the camshaft.

During engine operation, the camshaft carrying the pumping element is rotated in the engine to actuate the engine valves. Centrifugal force in the radial pumping passage of the pumping element acts as a centrifugal oil pump, boosting the pressure from the level supplied to the distribution oil passage to a greater pressure at the groove around the outer diameter of the pumping element. This higher pressure oil is delivered through the delivery passage to the cam phaser to provide boosted oil pressure for actuating the phaser.

These and other features and advantages of the invention will be more fully understood from the following description of certain specific embodiments of the invention taken together with the accompanying drawings.

BRIEF DESCRIPTION OF THE DRAWINGS

The drawing FIGURE is a diagrammatic view of an engine camshaft with a shaft pump formed in a rotatable pumping element of a camshaft according to an exemplary embodiment of the present invention.

DESCRIPTION OF THE PREFERRED EMBODIMENT

Referring to the drawing FIGURE in detail, numeral 10 generally indicates a portion of an internal combustion engine. The engine is provided with a housing 11 and support portions adapted to carry a rotatable shaft, such as camshaft mounts or support webs 12 having a plurality of bores 14 adapted for receiving journals 16 of a camshaft 18. The support webs 12 and the camshaft carried therein may be within a cylinder block of the engine 10 or within cylinder heads of the engine.

The camshaft 18 is also provided with a plurality of cam lobes 20, spaced axially intermediate the support webs 12 and adapted for actuating valves of the engine 10. If desired, journal bearings 22 may be fitted between the journals 16 and the support webs 12 of the engine. A cam phaser 24 connected with a front end 26 of the camshaft 18 receives pressurized oil from the engine through a plurality of interconnected oil passages 28 extending through the support portions of the engine 10 and the camshaft 18.

The oil passages 28 may be arranged in various configurations within the scope of the invention. Pressurized oil is supplied to the oil passages 28 from a main engine oil pump 29. Specifically, oil is supplied to the camshaft 18 from an engine oil feed passage 30 in a camshaft support web 12. The engine oil feed passage 30 connects with a groove 32 extending annularly in the insert or journal bearing 22, carrying oil to a cross drilled oil inlet passage 36 extending radially into a first journal 38. The oil inlet passage 36 further connects with a distribution passage 40 extending axially through the center of the camshaft 18. The distribution passage 40 connects with one or more radial journal lubrication passages 42 for delivering oil to the surface of the journals 16 to lubricate the journal bearings 34 along the length of the camshaft.

The shaft pump of the present invention includes the housing 11 and the camshaft 18, which has a pumping element 44 carried on the camshaft 18 and connecting with the distribution passage 40 upstream of the cam phaser 24. The pumping element 44 may be an enlarged journal of the camshaft which has an outer periphery 46 with a greater diameter than the other journals 16. The outer periphery 46 rotatably engages an enlarged bore 48 of the support web 12. If desired, an enlarged bearing 50 may be provided intermediate the pumping element 44 and the support web 46.

A pumping passage 52 extends radially from the distribution passage 40 to the outer periphery 46 of the pumping element 44. One or more outlet ends 54 of the pumping passage 52 open through the outer periphery 46 of the pumping element 44 and communicate with a delivery passage 56 connected to deliver oil to the cam phaser 24. The outlet ends 54 of the rotatable pumping element 44 and the stationary delivery passage 56 are preferably connected by an annular groove 58 in the web 12, or in the bearing 50 if provided. The delivery passage 56 is connected in any suitable manner to cam phaser 24 for delivering pressurized oil for actuating the phaser. For example, the passage 56 may be directed back through the web 12 to another camshaft journal 16 for connection with an axial passage 60 that communicates with the cam phaser 24.

In operation, the camshaft 18 carrying the pumping element 44 is rotated within the engine 10 to actuate valves of the engine and to oil as a centrifugal booster pump for increasing the pressure of oil supplied by the engine oil pump and delivered to the cam phaser 24. Oil is supplied to the oil feed passage 30 by the engine oil pump 29.

As the camshaft 18 is rotated, the oil inlet passage 36 of the camshaft 18 receives oil from the engine oil feed passage 30. This oil flows through the distribution passage 40 to the journal lubrication passages 42 which lubricate the journals 16 and the journal bearings 22.

Some of the oil flowing through the distribution passage 40, toward the front end 26 of the camshaft 18, enters the rotating pumping element 44 and connects with the radial pumping passage 52. Centrifugal force acting on the oil in the radial pumping passage 52 causes the pumping element 44 to act as a centrifugal oil pump, boosting the pressure from the level supplied to the distribution oil passage 40 to a greater pressure at outlet ends 54 and in the groove 58 around the outer periphery 46 of the pumping element. In the illustrated embodiment, this higher oil pressure is communicated through the delivery passage 56 and axial passage 60, to the cam phaser 24 to provide increased oil pressure for actuating the phaser and for lubricating a camshaft journal 16 downstream of the pumping element 44.

In an alternative embodiment, not shown, the cam phaser delivery passage 56 may be modified to bypass subsequent journals 16 and provide oil flow directly from the outlet ends 54 of the pumping element 44 to the cam phaser 24.

The pressure boosting action of centrifugal force, acting on the oil in the pumping element 44, provides the cam phaser 24 with higher oil pressure than is supplied to the rest of the engine 10, which is allowed to operate with normal oil pressure. As a result, a smaller more efficient engine oil pump may be used to provide lubrication for the engine while higher pressures required for operating the cam phaser are provided by the booster pumping element of the rotary shaft pump.

The boost in oil pressure produced by the pumping element 44 is determined by the diameter of the pumping element and the speed of rotation. As the rotational speed and the diameter of the pumping element 44 increases, oil pressure is increased proportionally to produce greater oil pressure for the cam phaser 24.

The illustrated embodiment of the invention is directed to its application to a camshaft. However, it should be understood that other rotatable shafts of an engine, such as a balance shaft, may be modified in a similar manner to camshaft 10 to provide a pump for boosting oil pressure supplied to a cam phaser or to other components of the engine.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A rotary shaft pump adapted for increasing a portion of main oil pressure supplied to a shaft in an internal combustion engine for use in actuating a pressure responsive device, the shaft pump comprising:

a housing adapted to carry a rotatable shaft for performing a function in an engine;

a shaft rotatably carried in the housing and adapted to receive pressurized lubricating oil for lubricating at least the shaft; and at least one radially extending pumping element carried by the shaft and having an enlarged outer diameter rotatable in an enlarged bore of the housing;

an oil distribution passage extending axially in the shaft, a pumping passage in the pumping element and extending radially from the oil distribution passage to the outer diameter of the pumping element; and a delivery passage in the housing and connecting with the outer diameter of the pumping element to receive pressurized oil from the pumping element for delivery to a hydraulically actuated device;

whereby during rotation of the shaft in engine operation, centrifugal force in the pumping passage boosts oil pressure at the outer diameter of the pumping element, providing increased oil pressure in the oil delivery passage for use in actuating the pressure responsive device.

2. A rotary shaft pump as in claim 1 including journal bearings intermediate journals on the shaft and the housing carrying the shaft.

3. A rotary shaft pump as in claim 1 wherein the shaft is a camshaft.

4. A rotary shaft pump as in claim 1 wherein the shaft is a balance shaft.

5. An engine having a main pump adapted to pressurize lubricating oil for delivery to moving components of the engine, the moving components including a rotary shaft having a plurality of axially spaced journals centered on an axis and carried for rotation in a support portion of the engine, the shaft including a central distribution passage connected to receive pressurized oil from the main pump for lubricating at least one of the journals, and the shaft connected to conduct pressurized oil to an oil pressure responsive device;

the shaft including a pumping element centered on the axis and having an outer diameter greater than that of said journals, the pumping element being rotatable within an enlarged bore of the support portion and including a pumping passage extending from the central distribution passage to the outer diameter of the pumping element; and a delivery passage communicating with the pumping passage at said pumping element outer diameter and connected with the oil pressure responsive device;

whereby during rotation of the shaft in engine operation, centrifugal force in the pumping passage boosts oil pressure at the outer diameter of the pumping element providing increased oil pressure in the oil delivery passage for use in actuating the pressure responsive device.

6. An engine as in claim 5 wherein the shaft is a camshaft.

7. An engine as in claim 5 wherein the shaft is a balance shaft.

8. An engine as in claim 5 wherein the support portion is in an engine block.

9. An engine as in claim 5 wherein the support portion is in a cylinder head.

10. A rotary shaft pump as in claim 1 wherein the shaft includes a plurality of journals and the pumping element is one of the journals having an outer diameter greater than that of the other journals.

11. A rotary shaft pump as in claim 10 wherein the shaft is connected to receive said pressurized lubricating oil from the housing through a radial feed passage in one of the other journals.

12. An engine as in claim 5 wherein the pumping element is one of the journals and has an outer diameter greater than that of the other journals.

13. An engine as in claim 5 wherein the pumping element is one of the journals and the pumping passage is connected to receive said pressurized oil from the main pump through a radial feed passage in one of the other journals.

* * * * *